United States Patent [19]

Oster et al.

[11] Patent Number: 4,862,131

[45] Date of Patent: Aug. 29, 1989

[54] TRIP CROSSBAR TRANSLATION TO PREVENT BIMETAL OVERSTRESSING IN A CIRCUIT BREAKER

[75] Inventors: Clark L. Oster, Cedar Rapids; Paul Rustebakke, Swisher; Daniel R. Schiefen, Cedar Rapids, all of Iowa

[73] Assignee: Square D Company, Palatine, Ill.

[21] Appl. No.: 255,559

[22] Filed: Oct. 11, 1988

[51] Int. Cl.[4] ..... H01H 71/16; H01H 75/08

[52] U.S. Cl. ..... 337/48; 335/8; 335/43; 337/70

[58] Field of Search ..... 337/48, 47, 46, 45, 337/49, 50, 70; 335/8, 9, 10, 23, 35, 43, 44, 38

[56] References Cited

U.S. PATENT DOCUMENTS

| | | | |
|---|---|---|---|
| 3,265,837 | 8/1966 | Klein | 335/23 |
| 3,319,196 | 5/1967 | Myers | 335/38 |
| 3,500,275 | 3/1970 | Oravec | 337/75 |
| 4,146,855 | 3/1979 | Schultz et al. | 335/8 |
| 4,220,935 | 9/1980 | Wafer et al. | 335/38 |
| 4,260,969 | 4/1981 | Troehel et al. | 335/38 |
| 4,472,701 | 9/1984 | Bellows et al. | 335/23 |
| 4,675,640 | 6/1987 | DiMarco et al. | 337/70 |

*Primary Examiner*—H. Broome

*Attorney, Agent, or Firm*—Thomas B. Lindgren; Jose W. Jimenez

[57] ABSTRACT

A circuit breaker for breaking current conduction between line and load connectors in response to tripping of a bimetallic thermal element as a result of an overcurrent condition is disclosed. According to the invention, a trip crossbar is permitted to translate as well as rotate to relieve stress on the thermal element.

7 Claims, 2 Drawing Sheets

TRIP CROSSBAR TRANSLATION TO PREVENT BIMETAL OVERSTRESSING IN A CIRCUIT BREAKER

DESCRIPTION

1. Technical Field

The invention relates to circuit breakers utilizing bimetallic thermal elements and, more particularly, to a circuit breaker which eliminates overstressing of the bimetallic thermal element.

2. Background Prior Art

Circuit breakers are utilized t break an electrical circuit in the event of an over-current condition. Such circuit breakers typically incorporate a bimetallic thermal element which deforms as a result of heating during an over-current condition to rotate a crossbar assembly. Rotation of the crossbar assembly trips a latch assembly to open the circuit.

However, as for example during a fault interruption, the current passing through the bimetallic thermal element can be excessively greater than that experienced during a typical over-current condition, resulting in an overheating of the bimetallic thermal element. In such instances, the bimetallic thermal element will attempt to deform more than constraints on the rotation of the crossbar will permit, overstressing the bimetallic thermal element as well as its structural mount.

This overstressing can result in a loss of calibration of the bimetallic element as well as a reduction in life of the circuit breaker itself.

SUMMARY OF THE INVENTION

It is an object of the present invention to provide a circuit breaker for breaking current conduction between line and load connectors in response to an overcurrent condition. In accordance with the invention, the circuit breaker comprises a supporting structure and a line terminal mounted on the supporting structure. The line terminal has a first end coupled to the line connector, and a second end. The circuit breaker further includes a blade having a first end and a second end, the blade being movable between a closed position and an open position.

The circuit breaker includes first means for biasing the blade towards the open position, means for latching the blade in the closed position, and a bimetallic thermal element coupling the second end of the blade with the load connector. The current passing between the line connector and the load connector when the blade is in the closed position passes through the thermal element, and the current develops a stress in the thermal element, causing the thermal element to deform. Means responsive to the deformation of the thermal element releases the latching means.

The releasing means includes a crossbar first rotatable an angular distance about a pivot to release the latching means and subsequently translatable away from the pivot axis to permit further deformation of the thermal element and relieve remaining stress on the thermal element.

Other features and advantages of the invention will be apparent from the specification taken in conjunction with the accompanying drawings.

DETAILED DESCRIPTION

Figure 1:
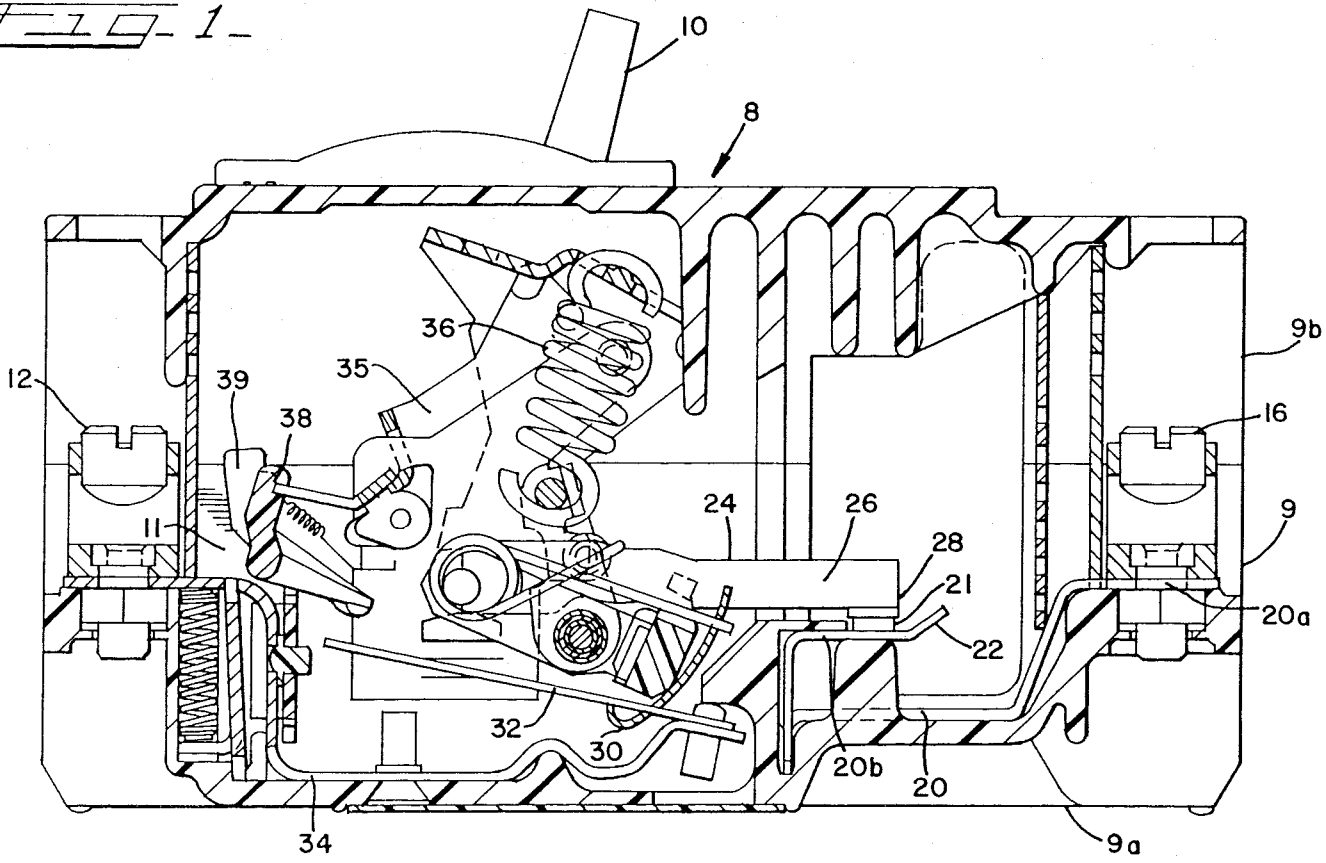
FIG. 1 is a section of a circuit breaker emboding the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A circuit breaker generally designated 8 according to the invention is illustrated FIG. 1. The circuit breaker 8 can be a single pole circuit breaker, a three pole circuit breaker, or a circuit breaker including any number of poles, as required.

The general structure and operation of a circuit breaker is detailed in Leonard, U.S Pat. No. 3,341,791, the specification of which is expressly incorporated herein by reference.

The circuit breaker 8 includes a supporting structure comprising a two-part case 9 having a base 9*a* and a cover 9*b*, and an operating handle 10, all preferably molded of an insulating material. Internal partition walls 11 separate respective phase chambers, as is well known in the art.

The circuit breaker 8 includes a load connector 12 to be coupled to an electrical load (not shown) and a line connector 16 to be coupled to an electrical supply (not shown).

The circuit breaker 8 further includes a line terminal 20 having a terminal end 20*a* coupled to the line connector 16, and a stationary contact end 20*b*. . The circuit breaker 8 further includes a contact carrier, or blade, 24 having a pivoting end 26 and a movable contact 28. A pigtail 30 is coupled between the pivoting end 26 of the blade 24 and a bimetallic thermal element 32. A load terminal 34 couples the bimetallic thermal element 32 to the load connector 12.

When the blade 24 is in contact with the line terminal 20, the circuit breaker 8 is in a "closed" position, and current is permitted to flow between the line connector 16 and the load connector 12. Correspondingly when the blade 24 is not in contact with the line terminal 20, the circuit breaker 8 is in an "open" position, and current is prevented from flowing between the line connector 16 and the load connector 12.

In operation when the circuit breaker 8 is in the closed position, electrical current flows sequentially through the line connector 16, the line terminal 20, the blade 24, the pigtail 30, the thermal element 32, the load terminal 34, ultimately through the load connector 12 to the load.

The circuit breaker 8 further includes a conventional latching mechanism 35, a more detailed description of which is contained in the above incorporated Leonard patent.

A bias spring 36 biases the blade 24 away from the line terminal 20, towards the open position The latching mechanism 35 opposes the bias spring 36 to releasably maintain the circuit breaker 8 in the closed position. A trip crossbar 38 extends laterally across the circuit breaker 8 and is supported within notches 39 in the partition walls 11 of the base 9a and the cover 9*b* of the case 9. As discussed below, when the thermal element 32 deforms sufficiently as a result of overheating during an overcurrent condition, the thermal element 32 operates to rotate the trip crossbar 38, releasing the latching mechanism 35. Release of the latching mechanism 35 causes the bias spring 36 to move the blade 24 to the open position.

Specifically as current travels between the line connector 16 and the load connector 12, the current passes through the thermal element 32. As it does, internal resistance of the thermal element 32 causes it to heat, the amount of heat being proportional to the magnitude of the current passing through the thermal element 32. As long as the current is at or below an acceptable level, the thermal element 32 does not deform sufficiently to rotate the trip crossbar 38 to release the latching mechanism 35. However, when an excessive amount of current passes through the thermal element 32, the thermal element 32 deforms sufficiently to rotate the trip crossbar 38 counter-clockwise with respect to FIG. 1, thereby releasing the latching mechanism 35 and permitting the bias spring 36 to move the blade 24 to the open position.

As a result of a typical overcurrent condition, the trip crossbar 38 rotates sufficiently to permit the thermal element 32 to deform completely. However, in certain excessive overheating conditions such as during a fault interruption, the thermal element 32 may cause the trip crossbar 38 to rotate completely, though not sufficiently to permit the thermal element 32 to completely deform, resulting in a stress remaining in the thermal element 32. This remaining stress, in view of the high temperature involved, can decalibrate the thermal element 32, causing the circuit breaker 8 in future operations to trip at an improper current level.

Previously the rotational constraint on the trip crossbar 38 was the size of the notches 39 in the internal walls 11. The notches 39 could not be increased in size to permit further rotation of the trip crossbar 38 and, hence to permit complete deformation of the thermal element 32, because of insufficient space in the circuit breaker case 9 to permit further rotation. Additionally, larger notches 39 would result in a greater opening between phase chambers, greatly increasing the likelihood of phase-to-phase arcing due to ionized gas in the chamber during breaking of the circuit.

Thus, according to the invention, the trip crossbar 38 is first permitted to rotate about an axis 40 sufficiently to permit release of the latching mechanism 35. After the trip crossbar 38 has rotated, and if additional deformation of the thermal element 32 is required, the trip crossbar 38 upwardly translates sufficiently to permit the thermal element 32 to completely deform. As the thermal element 32 cools and returns to its previous configuration, the trip crossbar 38 translates downwardly, and then rotates clockwise back to its initial position. A retaining spring 46 biases the trip crossbar 38 towards this initial position.

Figure 2:
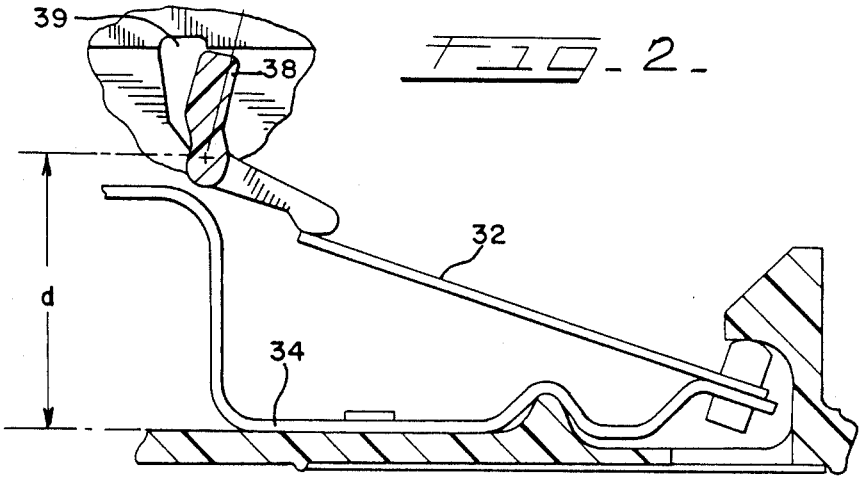
FIG. 2 is an enlarged partial view of FIG. 1 illustrating a crossbar in a non-rotated position.

The thermal element 32 is illustrated in FIG. 2 in its initial position, with the axis 40 a distance "d" from the base 9*a*. The thermal element 32 is not deformed.

Figure 3:
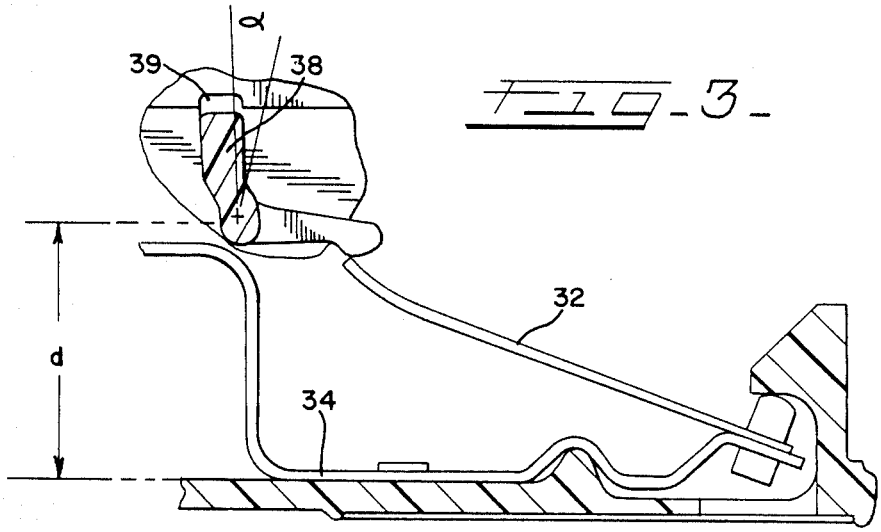
FIG. 3 is an enlarged partial view of FIG. 1 illustrating the crossbar in a rotated position; and, FIG. 4 is an enlarged partial view of FIG. 1 illustrating the crossbar in a translated position.

In FIG. 3, the thermal element 32 has begun deformation, causing the trip crossbar 38 to rotate an angle "alpha" to its fully rotated position, though the axis 40 remains the distance "d" from the base 9*a*.

Figure 4:
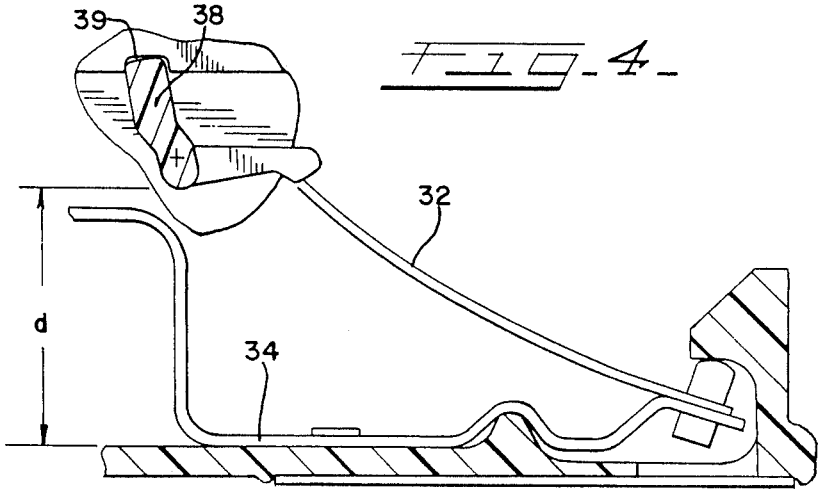

In FIG. 4, the thermal element 32 has fully deformed as a result of an over-current condition. The trip crossbar 38 has completely rotated to its rotated position and has translated upwardly a distance "1" from the axis 40.

Thus, it will be seen that the thermal element 32 is permitted to deform completely without either an increase in case size or a need to significantly increase the size of the notch 39 between the phase chambers.

It is possible that the connection of the electrical supply and the load with respect to the line terminal 20 and the blade 24 can be reversed such that the load connector 12 is coupled to the electrical supply and the line connector 16 is coupled to the load without departing from the scope of the invention. As such the claims appended hereto should be interpreted accordingly.

It will be understood that the invention can be embodied in other specific forms without departing from the spirit or central characteristics thereof. The present examples and embodiments described above, therefore, are to be considered in all respects as illustrative and not restrictive, and the invention is not to be limited to the details given herein.

We claim:

1. A circuit breaker for breaking an electrical circuit between an electrical supply and an electrical load in response to an over-current condition, the circuit breaker comprising;

a supporting structure;

a line connector for coupling said circuit breaker to said electrical supply, and a load connector for coupling said circuit breaker to said electrical load;

a line terminal mounted on said supporting structure and having a first end and a second end, said first end coupled to said line connector;

a blade having a first end and a second end, said first end coupled to said load connector, wherein said blade is movable between a closed position and an open position;

first means for biasing said blade towards said open position;

means for releasably latching said blade in said closed position;

a deforming thermal element conductively disposed between said blade second end and said load connector, wherein current passing between said line connector and said load connector when said blade is in said closed position passes through said thermal element, said current developing a stress in said thermal element, causing said thermal element to deform;

means responsive to said thermal element deformation for releasing said latching means, said responsive means including a trip crossbar first rotatable an angular distance about a pivot axis to release said latching means and subsequently translatable away from said pivot axis to relieve remaining stress on said thermal element.

2. The circuit breaker of claim 1 including means for biasing said trip crossbar towards said pivot axis.

3. In a circuit breaker for breaking current conduction between line and load connectors in response to an over-current condition, the circuit breaker including;

a case;

a line terminal mounted in said case and having a first end coupled to said line connector, and a second end;

a blade having a first end and a second end, said blade movable between a closed position and an open position;

first means for biasing said blade toward said open position;

means for releasably latching said blade in said closed position;

a bimetallic thermal element coupling said second end of said blade with said load connector, wherein said current passing between said line connector and said load connector when said blade is in said closed position passes through said thermal element, said current developing a stress in said thermal element, thereby causing said thermal element to deform; and a trip crossbar rotatable a fixed angular distance about a pivot axis, wherein deformation of said thermal element rotates said crossbar to release said latching means, permitting said first biasing means to move said blade to said open position and break the circuit:

the improvement wherein said thermal element translates said crossbar away from said pivot axis after said thermal element has rotated said crossbar said fixed angular distance, thereby further reducing remaining stress in said thermal element.

4. The improvement of claim 3 including means for biasing said crossbar towards said pivot axis.

5. In a circuit breaker housed within a molded case for breaking current conduction between line and load connectors in response to an over-current condition, the circuit breaker including;

a supporting structure attached to said housing;

a line terminal mounted on said supporting structure and having a first end coupled to a first of said connectors, and a second end;

a blade having a first end and a second end, said blade movable between a closed position and an open position;

first means for biasing said blade towards said open position;

means for latching said blade in said closed position, a bimetallic thermal element coupling said second end of said blade with a second of said connectors, wherein said current passing between said connectors when said blade is in said closed position passes through said thermal element, said current causing said thermal element to deform as a function of heat generated by the current passing therethrough; and a trip crossbar supported by said housing and rotatable about a pivot axis a fixed angular distance determined by said housing, wherein deformation of said bimetallic element beyond a predetermined amount rotates said crossbar to release said latching means, but said housing preventing sufficient rotation of said crossbar to permit complete deformation of said bimetallic element for all possible temperatures thereof, thereby causing a resultant stress in said bimetallic element:

the improvement wherein said housing permits said thermal element to translate said crossbar away from said pivot axis to permit further deformation of said bimetallic element.

6. The improvement of claim 5 including means for biasing said crossbar towards said pivot axis.

7. The improvement of claim 5 wherein said thermal element translates said crossbar away from said pivot axis after said thermal element has rotated said crossbar said fixed angular distance.

* * * * *